US010017959B2

(12) United States Patent
Perrins et al.

(10) Patent No.: US 10,017,959 B2
(45) Date of Patent: Jul. 10, 2018

(54) LOCK ARRANGEMENT

(71) Applicant: Janus International Group LLC, Temple, GA (US)

(72) Inventors: Jonathan Perrins, Brisbane (AU); Gerard Ryan, Brisbane (AU); Joshua Willoughby, Brisbane (AU); Mark Sandstrom, Brisbane (AU)

(73) Assignee: JANUS INTERNATIONAL GROUP LLC, Temple, GA (US)

( * ) Notice: Subject to any disclaimer, the term of this patent is extended or adjusted under 35 U.S.C. 154(b) by 0 days.

(21) Appl. No.: 15/423,224

(22) Filed: Feb. 2, 2017

(65) Prior Publication Data

US 2017/0198495 A1 Jul. 13, 2017

Related U.S. Application Data

(63) Continuation of application No. PCT/AU2014/000781, filed on Aug. 4, 2014.

(51) Int. Cl.

| | |
|---|---|
| ***E05B 15/12*** | (2006.01) |
| ***E05B 67/36*** | (2006.01) |
| ***E05B 9/04*** | (2006.01) |
| ***E05B 17/04*** | (2006.01) |
| ***E05B 65/00*** | (2006.01) |
| *E05C 1/04* | (2006.01) |

(52) U.S. Cl.

CPC ..... *E05B 17/2023* (2013.01); *E05B 9/04* (2013.01); *E05B 17/048* (2013.01); *E05B 65/0021* (2013.01); *E05B 67/36* (2013.01); *E05C 1/04* (2013.01)

(58) Field of Classification Search

CPC ..... E05B 17/2023; E05B 9/04; E05B 9/08; E05B 9/084; E05B 9/086; E05B 65/0021; E05B 67/36

USPC ..... 70/129, 367, 369–371

See application file for complete search history.

(56) References Cited

U.S. PATENT DOCUMENTS 2,059,698 A * 11/1936 Jacobi ..... E05B 9/086 70/216
3,465,557 A * 9/1969 Ryder ..... B05B 3/10 292/95
4,099,397 A * 7/1978 Dauenbaugh ..... E05B 9/084 70/371
4,381,656 A * 5/1983 Hayakawa ..... E05B 9/084 292/DIG. 53
4,910,982 A * 3/1990 Dana ..... E05B 9/08 70/370
5,251,467 A * 10/1993 Anderson ..... E05B 9/084 411/508
5,297,405 A * 3/1994 Manning ..... E05B 9/084 292/DIG. 38

(Continued)

OTHER PUBLICATIONS

International Search Report dated Oct. 9, 2014 for PCT Application No. PCT/AU2014/000781.

*Primary Examiner* — Suzanne L Barrett
(74) *Attorney, Agent, or Firm* — EIP US LLP

(57) ABSTRACT

The present invention is directed to a lock arrangement where a cylinder type lock with a skirt can be correctly positioned and orientated in a door latch by the use of complementary profiles that enable insertion in only one position and thereby provide ease of use and confirmation that the lock has been correctly inserted and locked.

19 Claims, 9 Drawing Sheets

(56) References Cited

U.S. PATENT DOCUMENTS

| | | | | | |
|---|---|---|---|---|---|
| 5,435,159 | A * | 7/1995 | Ramsauer | E05B 9/084 | 70/370 |
| 5,479,800 | A * | 1/1996 | Myers | E05B 15/1635 | 70/365 |
| 5,724,840 | A * | 3/1998 | Divito | B62D 43/007 | 70/371 |
| 5,884,510 | A | 3/1999 | Crocco et al. | | |
| 6,079,241 | A * | 6/2000 | Burleigh | E05B 9/084 | 70/370 |
| 6,295,850 | B1 * | 10/2001 | Anderson | E05B 9/086 | 70/337 |
| 6,523,379 | B2 * | 2/2003 | Teskey | E05B 9/084 | 70/370 |
| 6,595,033 | B1 * | 7/2003 | Hara | E05B 9/084 | 70/370 |
| D477,984 | S * | 8/2003 | Laabs | D8/343 | |
| 6,684,670 | B1 | 2/2004 | Agbay et al. | | |
| 7,100,408 | B2 * | 9/2006 | Nakasone | E05B 9/086 | 70/367 |
| 8,347,676 | B2 * | 1/2013 | de Andrade | E05B 9/084 | 70/370 |
| 2012/0103034 | A1 | 5/2012 | Shartel | | |

* cited by examiner

LOCK ARRANGEMENT

CROSS-REFERENCE TO RELATED APPLICATIONS

This application is a continuation of International Application No. PCT/AU2014/000781, filed Aug. 4, 2014. The above-referenced patent application is incorporated by reference in its entirety.

BACKGROUND OF THE INVENTION

Field of the Invention

The present invention relates to a lock arrangement for particular but not exclusive application in latches for hinged and roller doors. Reference in the specification will be made to the use of the lock arrangement with respect to roller doors of storage facilities but this reference is by example only and the invention is not limited to this application.

Description of the Related Technology

Removable cylinder locks are used for door latches. By way of example door latches with cylinder locks are used on hinge doors at storage facilities where it is important that the goods being stored are secured in the allocated storage bay. In use, a customer of a storage facility would hire a storage bay and buy a cylinder lock for use with the door latch to the storage bay.

A user would insert the cylinder lock into an aperture in the door latch to lock the door latch. However, the lock can be misaligned or not correctly inserted into a lock aperture within the door latch resulting in the latch not being securely locked.

OBJECT OF THE INVENTION

It is an object of the present invention to provide a lock arrangement which overcomes or at least ameliorates some of the abovementioned disadvantages.

SUMMARY

In one aspect the invention broadly resides in a lock arrangement used in association with a latch, said lock arrangement having a lock body having a first end with a key aperture for a key and spring biased locking members extendable from adjacent a second end, the lock body has a shape that provides orientation with respect to positioning in the latch.

In another aspect the invention broadly resides in a lock arrangement used in association with a latch, said lock arrangement including a lock body having a first end with a key aperture for a key and spring biased locking members extendable from adjacent a second end, the lock body has a shape that provides orientation with respect to positioning in the latch; a skirt substantially surrounding the lock body adjacent the first end and extending outwardly towards the second end, wherein the length of the skirt and the position of the skirt on the lock body is configured to be complementary to a receiving formation substantially surrounding a latch aperture and provide insertion position and orientation of the lock body so that the lock body can lock the latch in position.

In a further aspect the invention broadly resides in a lock arrangement used in association with a latch, said lock arrangement including a lock body having a first end with a key aperture for a key and spring biased locking members extendable from adjacent a second end, the lock body has a shape that provides orientation with respect to positioning in the latch; a skirt substantially surrounding the lock body adjacent the first end and extending outwardly towards the second end, said skirt has one or more gripping surfaces to facilitate handling and installation; wherein the length of the skirt and the position of the skirt on the lock body is configured to be complementary to a receiving formation substantially surrounding a latch aperture and provide insertion position and orientation of the lock body so that the lock body can lock the latch in position.

Preferably the receiving formation is integral with or attachable to the latch. Preferably the skirt is integral with or attachable to the lock body. Preferably the shape of the free end of the skirt is complementary to the shape of the extended end of the receiving formation. More preferably the shape of the free end of the skirt has a complementary contour profile to the shape of the extended end of the receiving formation. More preferably the shape of the free end of the skirt has a complementary curved profile to the curved shape of the extended end of the receiving formation. The position of the skirt free end and receiving formation extended end preferably provide reproducible positioning of the lock body relative to the latch. Preferably the positioning of the skirt with the receiving formation provides a visual confirmation of the correct positioning of the lock body. The skirt of the lock body has a complementary profile with the receiving formation to provide alignment with the latch aperture. Preferably the lock body is substantially flush with the skirt so that a minimal amount of the lock body protrudes when in the locked position to minimize risk of injury and provide adequate clearance during use.

The lock body can be of any suitable shape including cylindrical and ovoid. Preferably the lock body is oval in cross-section and provide orientation with respect to positioning. Preferably, the lock body has a key cylinder. Preferably, the key cylinder in the lock body can move between a locked position and an unlocked position. In the locked position the locking members are preferably extended and in the unlocked position the locking members are preferably retracted. In alternate embodiments, any suitable key types can be used for the lock barrel including a flat key. Preferably, the profile of the lock body is configured to complement the shape of the lock receiving formation to provide a visual reference to a user. Preferably, the lock body is configured to only be receivable within the lock receiving formation when aligned in one or two orientations. Alternatively the lock body is preferably configured to only be receivable within the lock receiving formation when aligned in one direction and 180 degrees out of alignment of said one direction. Preferably, the profile of the lock body engageable with the lock receiving formation is configured to have at least two lines of symmetry. Preferably, the profile of the lock body engageable with the lock receiving formation is asymmetrical in at least one or more planes. Preferably, the profile of the lock body is substantially elliptical. Preferably, the profile of the lock body is substantially oval. Preferably, the skirt is configured to extend at least partially around the lock body. Preferably, the complementary contour profile is configured and adapted for engaging in a close fitting manner the skirt with the receiving formation when the lock body is at least partially received within the latch. Preferably, the locking members are extendable transversely from the lock body between their retracted position and their extended position. Preferably, the locking members are biased towards their extended position. Preferably, the key cylinder is engageable by a key to move the locking members from their extended position towards their retracted position. Preferably, movement of the key cylinder by a key to move the key cylinder to its unlocked position, moves the locking members to their retracted position. Preferably, the locking members are configured to be engageable with locking ridges on the latch to restrict removal of the lock body from said receiving formation in operation. Preferably, the locking members are configured to be engageable with locking ridges located on an inner surface of the shaped protrusion in operation, to thereby restrict removal of the lock arrangement from said lock receiving formation in operation.

Preferably the grip surface of the skirt allows finger(s) to grip the lock arrangement for positioning purposes. Preferably the grip surface is on an upper and or lower surface of the lock arrangement. In one form the grip surface includes one or more substantially parallel ridges. In one preferred form the lock and or skirt can be color coded to indicate status of tenanted space.

For the purposes of this specification, the term "aperture" is defined to include, but not be limited to, holes, bores, gaps and and/or passages through matter, as well as a recess or recesses that serves the same purpose as an aperture.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF CERTAIN INVENTIVE EMBODIMENTS

Figure 1:
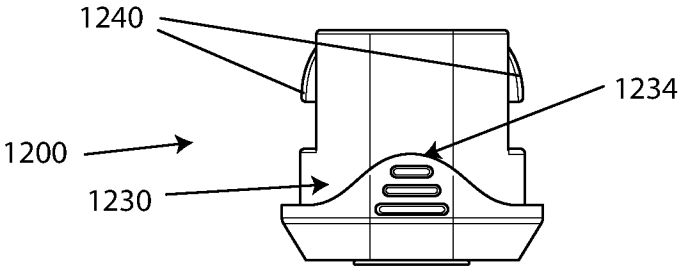
FIG. 1 is a top view of a first embodiment of a lock arrangement.
Figure 2:
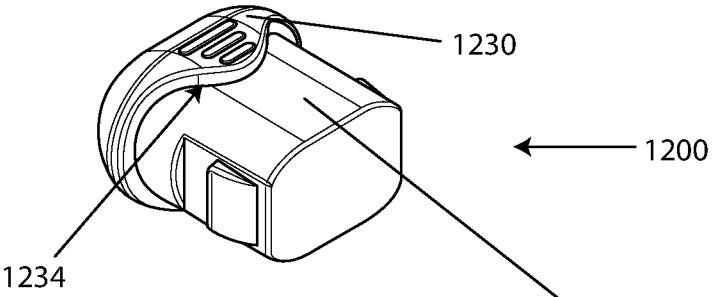
FIG. 2 is a top rear perspective view of a lock arrangement of FIG. 1.
Figure 3:
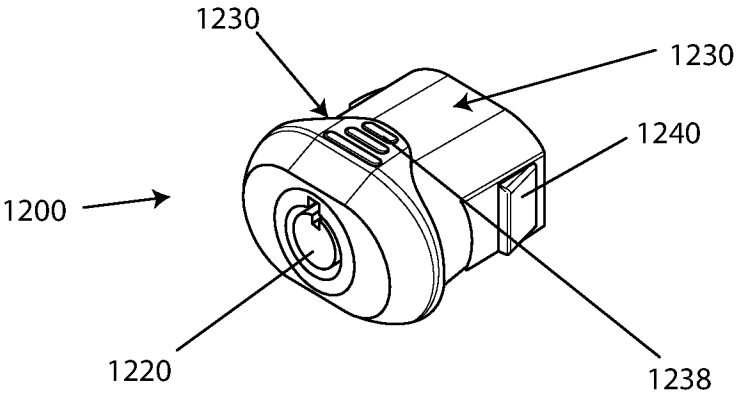
FIG. 3 is a top front perspective view of a lock arrangement of FIG. 1.
Figure 4:
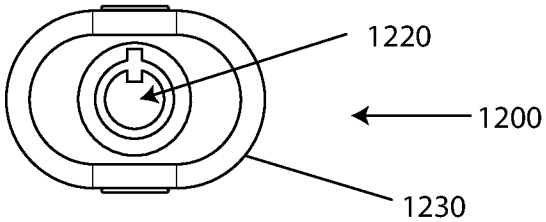
FIG. 4 is a front view of a lock arrangement of FIG. 1.
Figure 6:
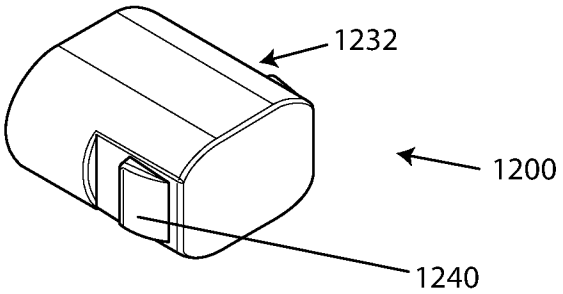
FIG. 6 is a top rear perspective view of a lock arrangement of FIG. 5.
Figure 8:
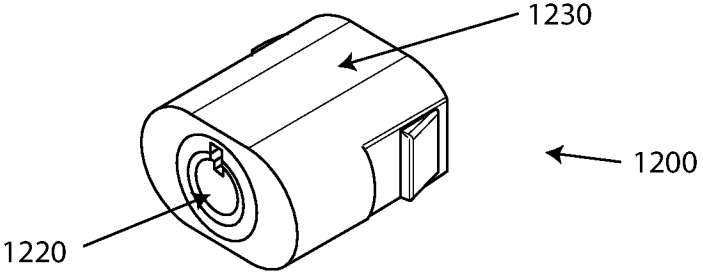
FIG. 8 is a top front perspective view of a lock arrangement of FIG. 5.
Figure 5:
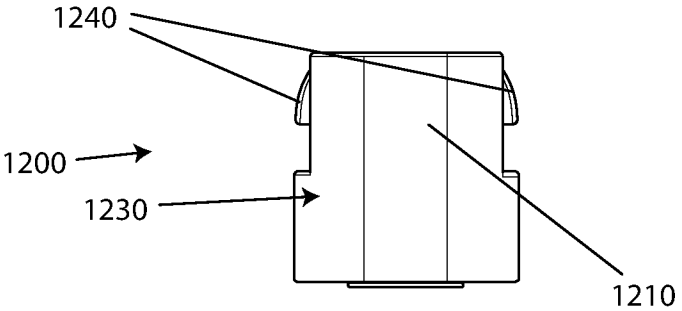
FIG. 5 is a top view of the lock arrangement without a skirt.
Figure 7:
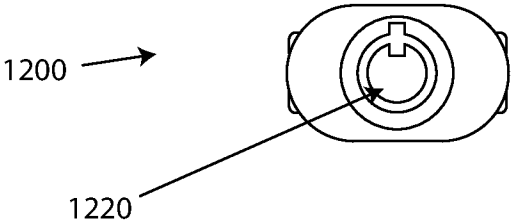
FIG. 7 is a front view of a lock arrangement of FIG. 5.
Figure 10:
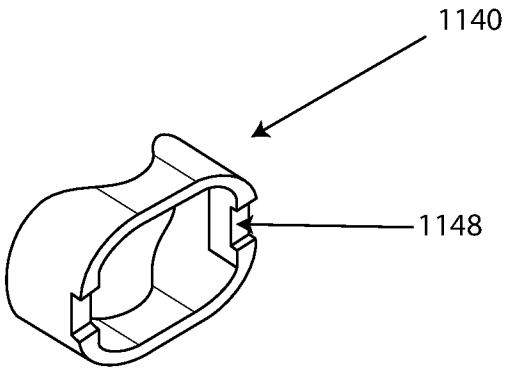
FIG. 10 is a top rear perspective view of a shaped protrusion of FIG. 9.
Figure 9:
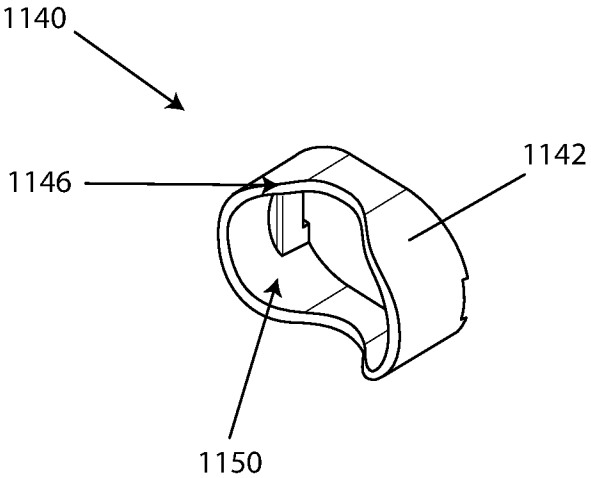
FIG. 9 is a top front perspective view of a shaped protrusion.
Figure 11:
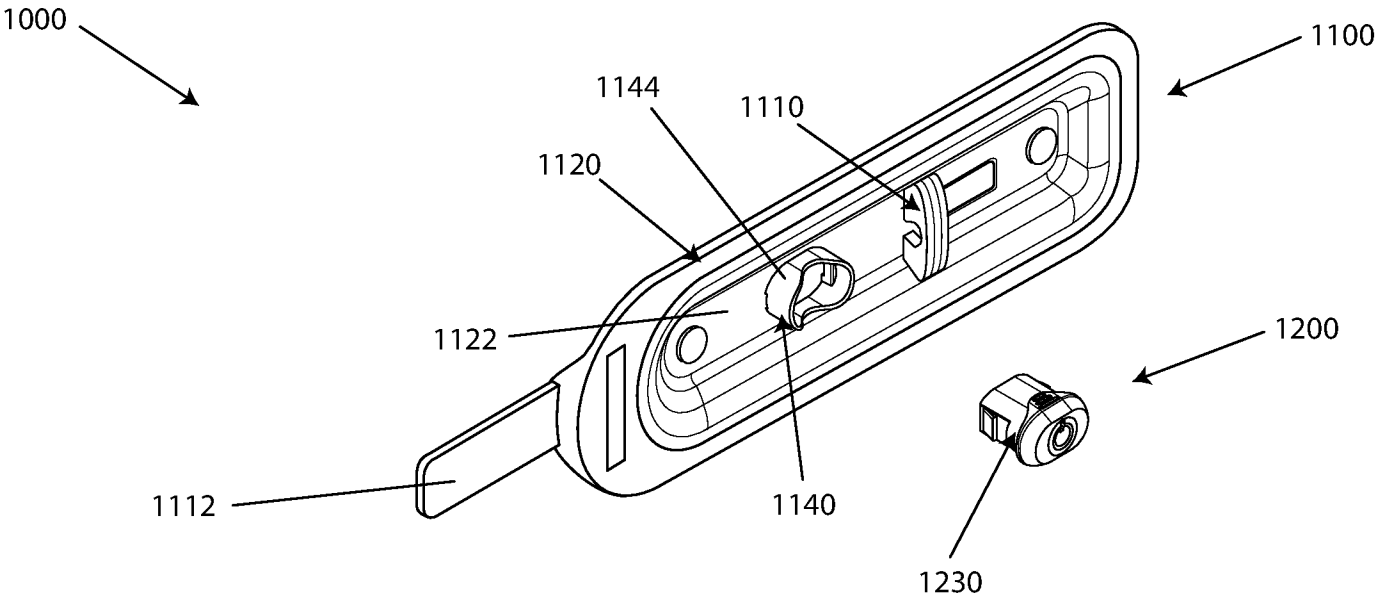
FIG. 11 is a top front perspective assembly view of a lock arrangement with the latch member in an extended position.
Figure 12:
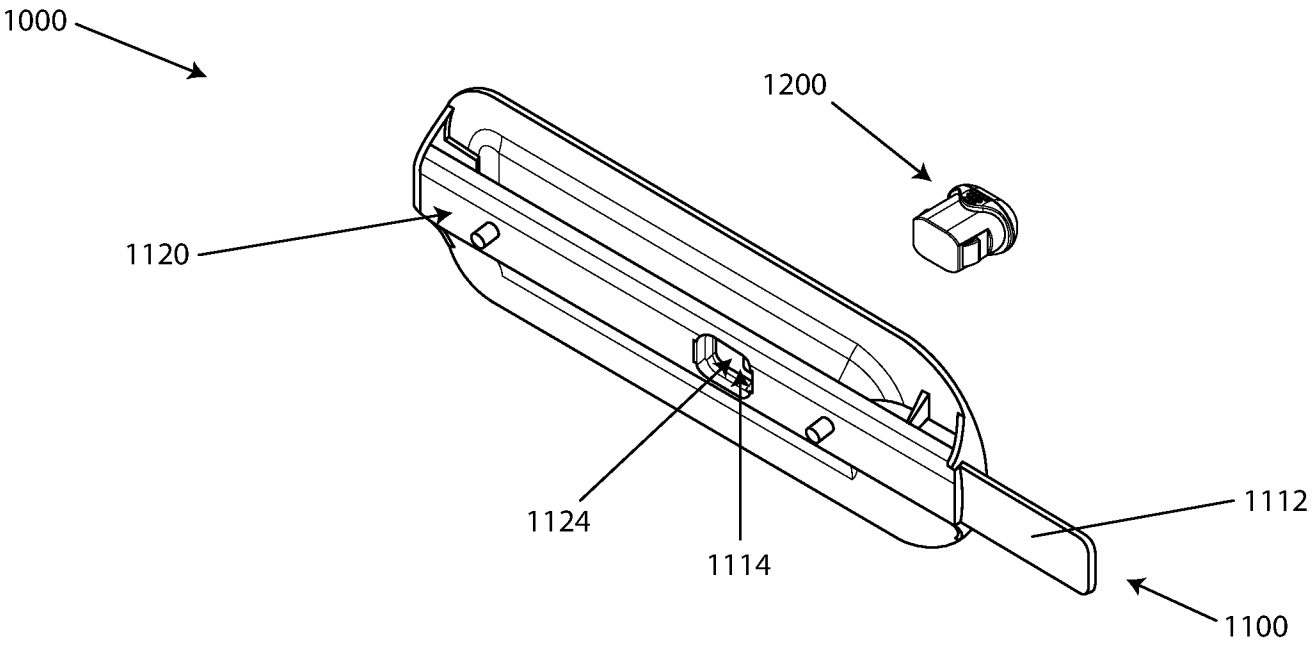
FIG. 12 is a top rear perspective assembly view of the lock arrangement of FIG. 11 with the latch member in an extended position.
Figure 13:
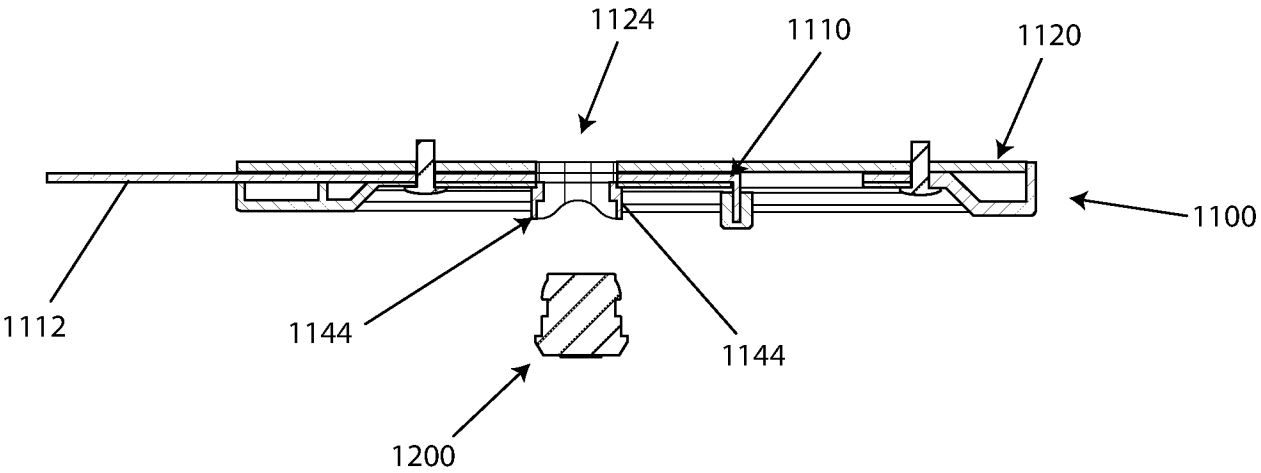
FIG. 13 is a top section view of the lock arrangement of FIG. 11 with the latch member in an extended position.
Figure 14:
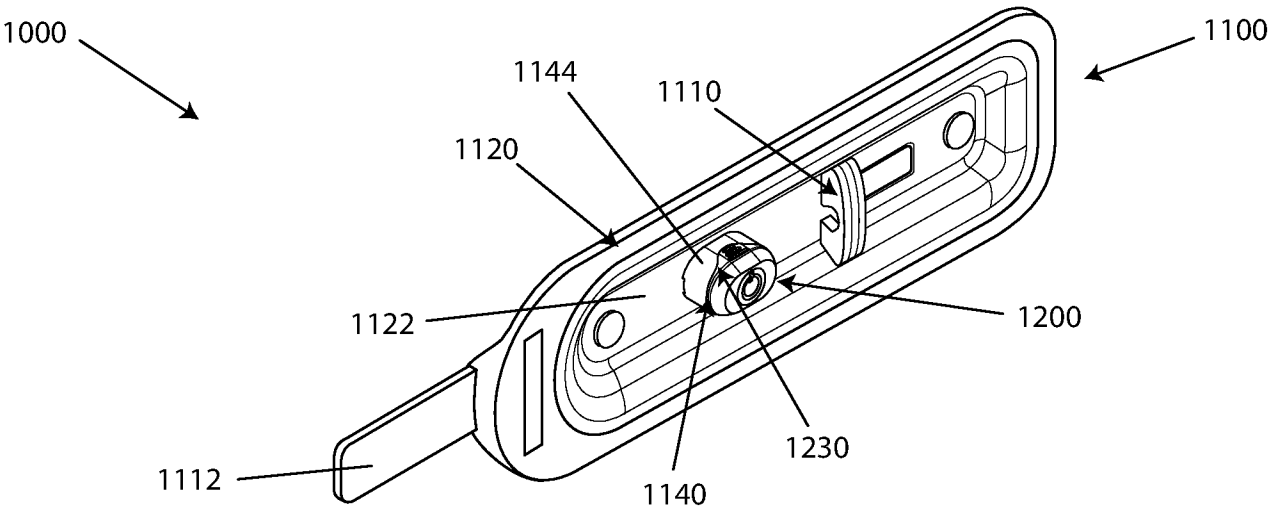
FIG. 14 is a top front perspective view of a lock arrangement with the locking arrangement received in the lock receiving formation.
Figure 15:
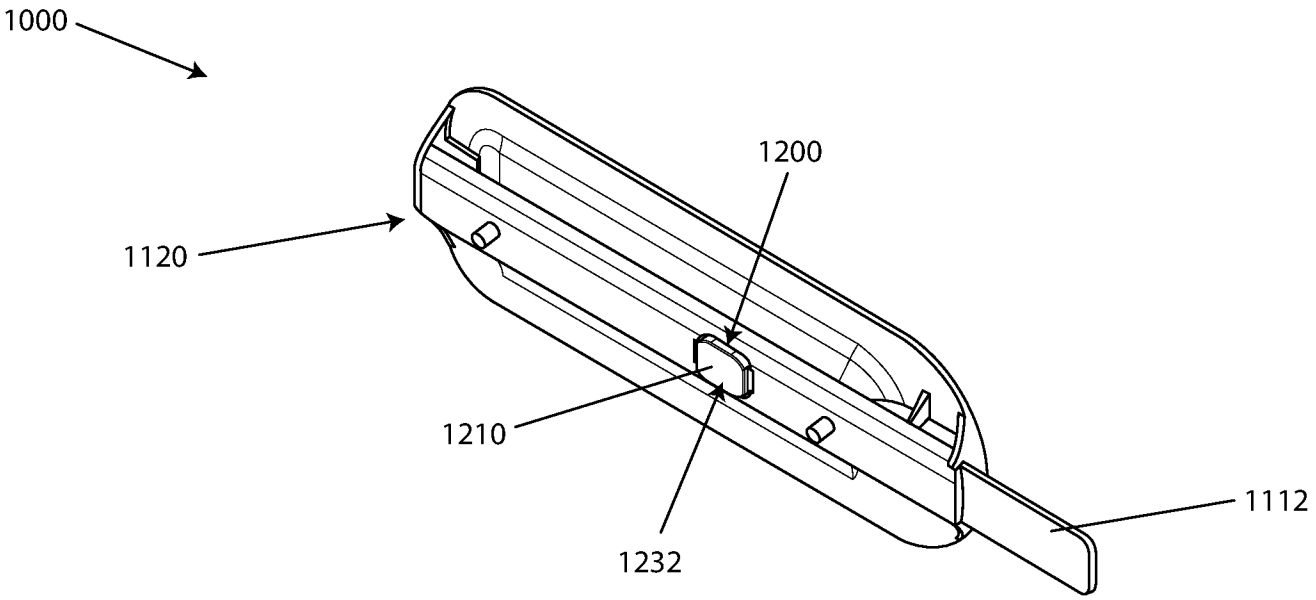
FIG. 15 is a top rear perspective assembly view of the lock arrangement of FIG. 14 with the locking arrangement received in the lock receiving formation.
Figure 16:
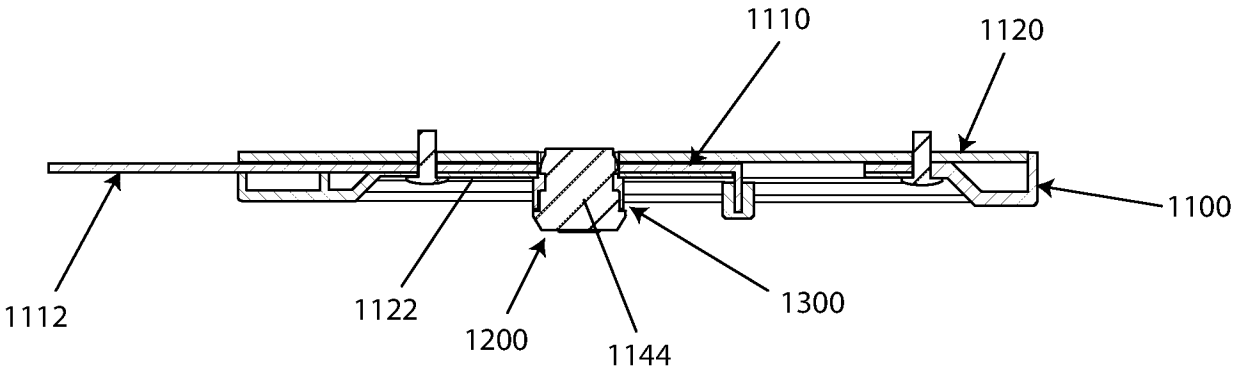
FIG. 16 is a top section view of the lock arrangement of FIG. 14 with the locking arrangement received in the lock receiving formation.

With reference to the above drawings, in which similar features are generally indicated by similar numerals, a locking assembly is indicated by the numeral 1000.

In one embodiment now described, there is provided a locking assembly 1000 suitable for locking a roller door (not shown). The locking assembly 1000 comprises a latch assembly 1100 and a lock arrangement 1200.

The latch assembly 1100 comprises a latch tongue 1112 and a base arrangement 1120 securable to a roller door by means of securing formations (not shown). The latch tongue 1112 is movable between an extended position and a retracted position to latch the roller door. The latch tongue 1112 defines a tongue aperture 1114.

The base arrangement 1120 comprises a base plate 1122, and the base plate 1122 defines a latch aperture 1124.

The latch tongue 1112 is elongate and planar. The latch tongue 1112 is movable between an extended position and a retracted position. The latch assembly 1100 is configurable to at least partly define a lock receiving formation 1140. The lock receiving formation 1140 is in the form of a shaped protrusion 1144 surrounding a latch aperture 1124 configured to receive the lock arrangement 1200. The profile shape of the protrusion 1144 is substantially oval or elliptical to complement the profile shape of the lock arrangement 1200. In another embodiment the latch tongue could also be locked in its retracted position. The latch tongue 1112 is locked in its extended position by inserting the lock arrangement 1200 into the shaped protrusion 1144, the latch aperture 1124 and the tongue aperture 1114. The tongue aperture 1114 must be aligned with the latch aperture 1124 to allow the insertion of the lock arrangement 1200. Insertion of the lock arrangement 1200 into the tongue aperture 1114 and latch aperture 1124 prevents movement of the latch tongue 1112 relative to the base arrangement 1120.

In an alternative embodiment the lock arrangement need not be inserted into a tongue aperture, but could merely protrude into the path of movement of the latch tongue when it is in its extended position to prevent movement of the latch tongue into its retracted position.

In a further embodiment the lock arrangement need not directly engage with the latch tongue, but could instead move an indirect coupling (not shown) to restrict movement of the latch tongue from its extended position.

The latch assembly 1100 and lock arrangement 1200 are complementarily configured to engage with each other operationally.

The shaped protrusion 1144 is integrally formed with the base arrangement 1120 or alternately secured to the base arrangement. The shaped protrusion 1144 extends from the base arrangement 1120 to a free end 1146. At the free end 1146, the shaped protrusion 1144 defines a curved contoured profile. It will be appreciated that a wide variety of profiles are possible and may be suitable for providing the advantages discussed below.

The shaped protrusion 1144 defines a pair of locking ridges 1148 on an inner surface 1150. These locking ridges 1148 are involved in the locking of the lock arrangement 1200.

The shaped protrusion 1144, the tongue aperture 1114 (in its extended position) and the latch aperture 1124 together define the insertion passage for the lock arrangement 1200. The lock arrangement 1200 comprises a lock body 1210 within which is housed a key cylinder 1220. The key cylinder 1220 is engageable by a key (not shown) to move between a locked position and an unlocked position. The lock body 1210 is elliptical or substantially oval in shape, to complement the shaped profile of the shaped protrusion 1144.

The lock arrangement 1200 further comprises at least one and preferably a pair of opposed locking members 1240 that are movable between an extended and a retracted position. The locking members 1240 are biased to extend transversely from the lock body in their extended position when the key cylinder 1220 is in its locked position, and when the key cylinder 1220 is moved to its unlocked position this causes movement of the locking member 1240 to their retracted position.

The lock arrangement 1200 also comprises a skirt 1230 that extends around an outer surface of the lock body 1210. The skirt 1230 need not necessarily extend all the way around lock body but it is preferable as this will allow a friction fit onto the lock body 1210. The skirt 1230 also extends towards the end with the locking member 1240 and the free end 1234 of the skirt 1230 has a profile complementary to the profile of the shaped protrusion 1144. The skirt 1230 is a plastic accessory fitting onto the lock body 1210. In another embodiment the skirt 1230 is integrally formed or secured to the lock body 1210 in a wide variety of other ways.

The contoured profiles are configured so that the lock arrangement 1200 can only be inserted into the shaped protrusion 1144 to cause the contoured profiles to fit together when the lock arrangement 1200 is aligned in one of two planes. In this alignment, the lock arrangement 1200 can be inserted into the shaped protrusion 1144 with the skirt 1230 and the shaped protrusion 1144 moving to be in a complementary alignment. The correct orientation and alignment of the lock arrangement 1200 with the shaped protrusion 1144 is achieved by the ovoid shape of the lock arrangement 1200 and the mating of the complementary profiles.

The locking members 1240 can move to their extended position when the skirt 1230 and the shaped protrusion 1144 are abutting. The locking members 1240 are extended and engage with the locking ridges 1148 to prevent extraction of the lock arrangement 1200. During insertion of the lock arrangement 1200 into the shaped protrusion 1144 and latch aperture 1124, the locking members 1240 will be pushed towards their retracted position by the inner surface 1150. As the lock arrangement is inserted to the required depth, and the locking members 1240 move past the locking ridges 1148, they will be free to move to their extended position under their bias. This will create a clicking or snapping noise, providing an audible confirmation to the correct alignment and depth of insertion.

Further, the depth of insertion will be such that the lock arrangement 1200 will extend into the path of movement of the latch tongue 1112 from its extended position to its retracted position, and into the tongue aperture 1114, thereby preventing movement of the latch tongue 1112 from its extended position.

The skirt 1230 further comprises gripping formations 1238 for providing grip to a user when inserting the lock arrangement 1200 into the shaped protrusion 1144.

Advantages

The advantages of the present invention include the provision of a visual cue to the user as to the required alignment/orientation of the lock arrangement as it is inserted by a user into the latch aperture, as well as to the depth of insertion required to ensure secure engagement of the locking members. This will ensure correct locking of the latch tongue and reduce the chances of unintentionally leaving doors unlocked.

The lock arrangement includes a cylinder type lock with a skirt that can be correctly positioned and orientated in a door latch by the use of complementary profiles thereby enabling insertion in only one position and provide ease of use and confirmation that the lock has been correctly inserted and locked.

The use of the oval shaped lock of the preferred embodiment provides the advantage to the owner or operator of a lockable facility that only oval shaped cylinder locks can be used by the tenant in order to secure the tenanted space.

The lock arrangement can be used by owners and operators of storage facilities to lock storage bays where there is a dispute with the tenant and the latch allows the insertion of the lock arrangement to prevent unauthorized access.

Variations

The lock arrangement is not fully received within the latch in the embodiments shown, however it is envisaged that it may be in other embodiments. In other alternative embodiments (not shown), the latch engaging formation may not be hollow or present an aperture at all, the base plate may not have an aperture with the locking arrangement extending along a side of the base plate, and in fact the base arrangement may not be a base plate at all, and could be of a wide variety of configurations, such as an elongate round bar, or any other suitable configuration for the purpose. Further, the latch tongue may not have an aperture, and instead the locking arrangement may simply engage with an exterior surface of the latch tongue to restrict movement from its extended position.

It will of course be realized that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

What is claimed is:

1. A lock arrangement used in association with a latch, the lock arrangement including:

a lock body having:

a first end with a key aperture for a key;

spring biased locking members configured to:

extend transversely from adjacent a second end of the lock body and engage with the latch based on the key being in a locked position, and retract transversely from adjacent the second end of the lock body and disengage from the latch based on the key being in an unlocked position; and a shape that provides orientation with respect to positioning in the latch; and a skirt substantially surrounding the lock body adjacent the first end and extending outwardly towards the second end, wherein the length of the skirt and the position of the skirt on the lock body is configured to be complementary to a receiving formation substantially surrounding a latch aperture and provide insertion position and orientation of the lock body so that the lock body can lock the latch in position.

2. A lock arrangement used in association with a latch, the lock arrangement including:

a lock body having:

a first end with a key aperture for a key;

spring biased locking members configured to:

extend transversely from adjacent a second end of the lock body and engage with the latch based on the key being in a locked position, and retract transversely from adjacent the second end of the lock body and disengage from the latch based on the key being in an unlocked position; and a shape that provides orientation with respect to positioning in the latch; and a skirt substantially surrounding the lock body adjacent the first end and extending outwardly towards the second end, the skirt has one or more gripping surfaces to facilitate handling and installation, wherein the length of the skirt and the position of the skirt on the lock body is configured to be complementary to a receiving formation substantially surrounding a latch aperture and provide insertion position and orientation of the lock body so that the lock body can lock the latch in position.

3. The lock arrangement of claim 1, wherein the receiving formation is integral with or attachable to the latch.

4. The lock arrangement of claim 1, wherein the skirt is integral with or attachable to the lock body.

5. The lock arrangement of claim 1, wherein a shape of a free end of the skirt is complementary to a shape of an extended end of the receiving formation.

6. The lock arrangement of claim 1, wherein a shape of a free end of the skirt has a complementary curved profile to a curved shape of an extended end of the receiving formation.

7. The lock arrangement of claim 1, wherein a shape of a free end of the skirt and a shape of an extended end of the receiving formation are complementary and provide insertion position and orientation of the lock body.

8. The lock arrangement of claim 1, wherein the positioning of the skirt with the receiving formation provides a visual feedback confirmation of the correct positioning of the lock body.

9. The lock arrangement of claim 1, wherein the lock body is oval in cross-section and provide orientation with respect to positioning.

10. The lock arrangement of claim 2, wherein the grip surface is on an upper and or lower surface of the lock arrangement.

11. The lock arrangement of claim 1, wherein the skirt of the lock body has a complementary profile with the receiving formation to allow the skirt to abut the receiving formation to confirm the depth and orientation of insertion of the lock body, and wherein the receiving formation is aligned with the latch aperture.

12. The lock arrangement of claim 1, wherein the locking members move to their extended position when the skirt and the receiving formation are complementary aligned, wherein the locking members engage with locking ridges on the receiving formation to prevent extraction of the lock body.

13. The lock arrangement of claim 2, wherein the receiving formation is integral with or attachable to the latch.

14. The lock arrangement of claim 2, wherein the skirt is integral with or attachable to the lock body.

15. The lock arrangement of claim 2, wherein a shape of a free end of the skirt is complementary to a shape of an extended end of the receiving formation.

16. The lock arrangement of claim 2, wherein a shape of a free end of the skirt has a complementary curved profile to a curved shape of an extended end of the receiving formation.

17. The lock arrangement of claim 2, wherein a shape of a free end of the skirt and a shape of an extended end of the receiving formation are complementary and provide insertion position and orientation of the lock body.

18. The lock arrangement of claim 2, wherein the lock body is oval in cross-section and provide orientation with respect to positioning.

19. The lock arrangement of claim 2, wherein the skirt of the lock body has a complementary profile with the receiving formation to allow the skirt to abut the receiving formation to confirm the depth and orientation of insertion of the lock body, wherein the receiving formation is aligned with the latch aperture.

* * * * *